United States Patent [19]

Lester

[11] Patent Number: 4,781,168

[45] Date of Patent: Nov. 1, 1988

[54] ARCHERY BOW

[76] Inventor: Wayne L. Lester, 3935 Willow Run, Flower Mound, Tex. 75028

[21] Appl. No.: 913,987

[22] Filed: Oct. 1, 1986

Related U.S. Application Data

[63] Continuation-in-part of Ser. No. 880,203, Jun. 30, 1986, abandoned.

[51] Int. Cl.[4] ..... F41B 5/00

[52] U.S. Cl. ..... 124/24 R; 124/DIG. 1

[58] Field of Search ..... 124/23 R, 24 R, DIG. 1

[56] References Cited

U.S. PATENT DOCUMENTS

| | | | |
|---|---|---|---|
| 4,201,182 | 5/1980 | Butler | 124/24 R |
| 4,261,320 | 4/1981 | Burna | 124/24 R |
| 4,287,867 | 9/1981 | Islas | 124/24 R |
| 4,667,649 | 5/1987 | Humphrey | 124/24 R |
| 4,672,943 | 6/1987 | Bozek | 124/23 R |

*Primary Examiner*—Richard C. Pinkham
*Assistant Examiner*—Benjamin Layno
*Attorney, Agent, or Firm*—Kanz, Scherback & Timmons

[57] ABSTRACT

An archery bow having spaced upper and lower pulley assemblies rotatively mounted on either end of the bow handle. Upper and lower limbs are pivotally mounted on either end of the handle. A bowstring extends between the tips of the limbs. A pair of tension cables connect the upper and lower limbs together, with each of the tension cables engaging one of the pulley assemblies. The tension cables further engage another set of pulley assemblies each rotatively mounted on the upper and lower limbs. Adjustment devices are provided to independently adjust the tension on the tension cables.

9 Claims, 3 Drawing Sheets

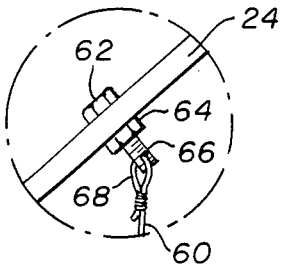
FIG. 1A
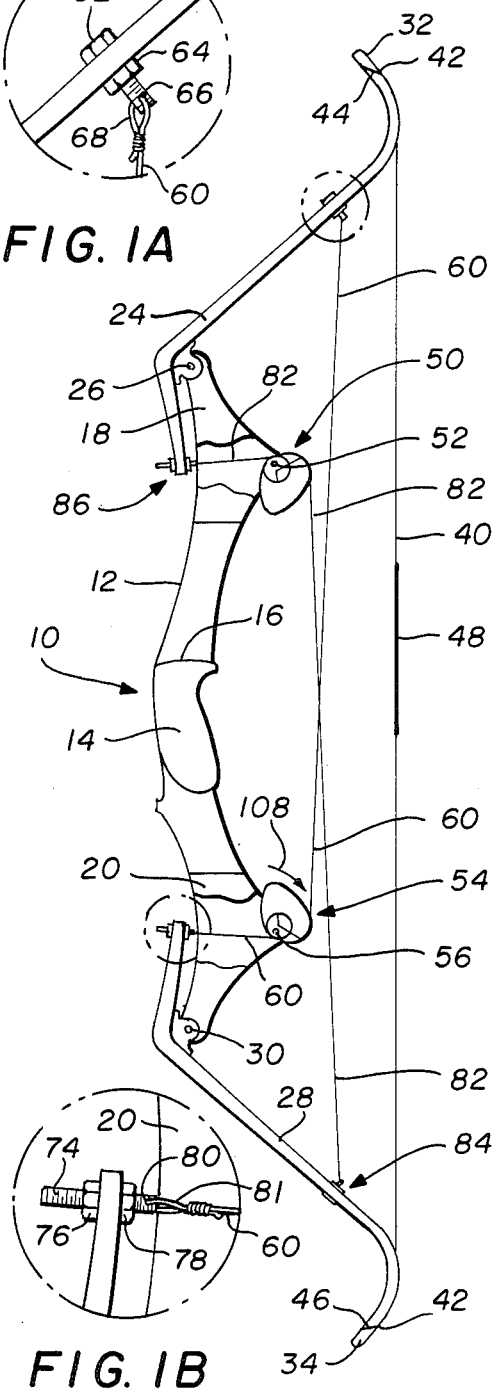
FIG. 1B
FIG. 1
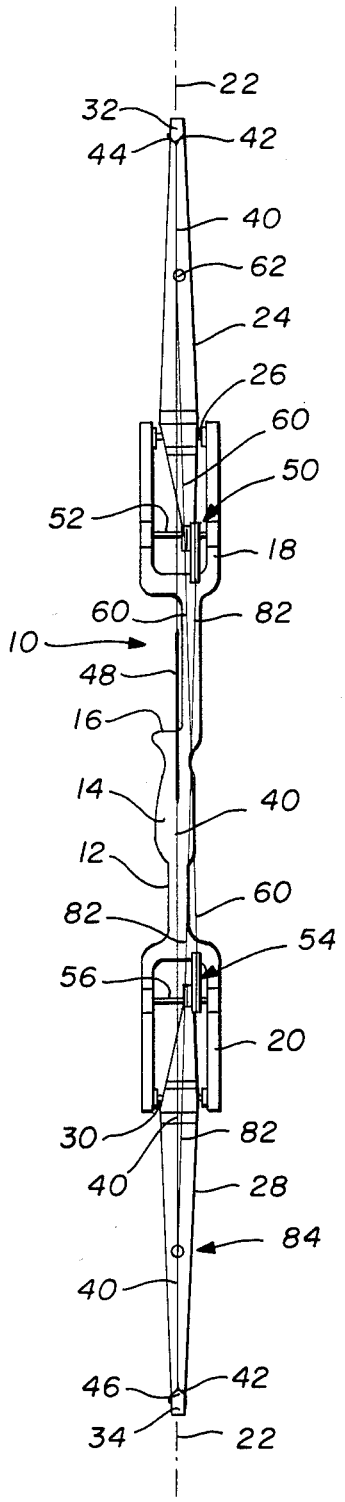
FIG. 2

ARCHERY BOW

This is a continuation-in-part of U.S. patent application Ser. No. 880,203 filed June 30, 1986, since abandoned and entitled "Archery Bow".

FIELD OF THE INVENTION

This invention relates generally to archery bows and more particularly to an improved compound bow.

BACKGROUND OF THE INVENTION

Archery bows have been known in the past which employ various pulleys and cams mounted on the bow to provide the archer with a mechanical advantage in drawing back the bowstring. Such bows are referred to as compound bows and are advantageous over conventional bows in that the compound bow increases the energy stored by the bow while reducing the force required to maintain the bow in a fully drawn position. For instance, a compound bow is shown in U.S. Pat. No. 4,372,285, issued to Simonds et al. The bow in Simonds et al. includes a handle portion, two projecting limbs mounted on the handle portion, and a bowstring mounted at each end to the tips of the limbs. The bowstring is wound about a pair of pulley assemblies, each of the pulley assemblies being mounted on one of the tips of the limbs to provide the mechanical advantage previously discussed.

However, such conventional compound bow designs are not completely satisfactory in several respects. First, the pulley assemblies represent substantial mass and inertia added to the tips of the limbs. This mass retards and attenuates the movement of the limbs from the fully drawn position to a relaxed position as the arrow is released. Further, the bow tips have an undesirable tendency to rebound after releasing the arrow. Thus, the bow is less efficient than otherwise might be the case. In conventional compound bows, the bowstring is usually connected at either end to one or more cables and to various pulleys to provide the mechanical advantage for the bow. However, while the bowstring is aligned with the centerline of the bow, the cable or cables must be deflected from the centerline to accommodate the arrow nocked on the bowstring. This may be accomplished by lateral spacing of the pulleys engaging the bowstring with respect to the pulleys engaging the cables. However, this arrangement typically results in a side thrust imparted to the arrow, reducing accuracy and arrow speed. Alternatively, cable guards may be used to deflect the cable or cables. However, this also results in a side loading on the arrow and additionally increases the friction on the cables, reducing the overall efficiency of the bow.

SUMMARY OF THE INVENTION

An archery bow having a handle and a pair of limbs mounted on the handle. The tips of the limbs may be straight but are preferably recurved. A bowstring extends between the tips and is connected at either end thereto. Spaced upper and lower pulley assemblies are mounted on the bow. The pulley assemblies are mounted on the bow so as to minimize the mass of the limbs and to increase the energy transferred to the arrow from the bow. Separate tension cables are mounted on one end to one of the upper and lower limbs, and on another end engaging one of the pulley assemblies. The bowstring is aligned with the centerline of the bow, but the tension cables are offset therefrom adjacent the arrow shelf. The pulley assemblies enable energy to be stored in the bow at its fully drawn position, yet the force is reduced at the fully drawn position to enable the archer to steady and aim the arrow with greater precision.

Therefore, it is a principal feature and advantage of this invention to provide an improved archery bow.

It is another feature and advantage of this invention to provide an improved archery bow which is accurate and lightweight.

BRIEF DESCRIPTION OF THE DRAWINGS

So that the manner in which the above recited features and advantages of the invention, as well as others which will become apparent to those skilled in the art, are obtained and can be understood in detail, a more particular description of the invention briefly summarized above may be had by reference to the embodiments thereof which are illustrated in the accompanying drawings, which drawings form a part of the specification and in which like numerals depict like parts in the several views. It is noted, however, that the appended drawings illustrate only a preferred embodiment of the invention and are therefore not to be considered limiting of its scope, for the invention may admit to other equally effective embodiments.

FIG. 1 is a side view, partially broken away, of an archery bow constructed according to this invention.

FIG. 1*a* is a magnified view in detail of an end of one of the tension cables connected to a limb.

FIG. 1*b* is a magnified view in detail of the other end of the tension cable of FIG. 1*a* connected to a limb.

FIG. 2 is a back view of the archery bow of FIG. 1.

DETAILED DESCRIPTION OF THE INVENTION

Figure 3:
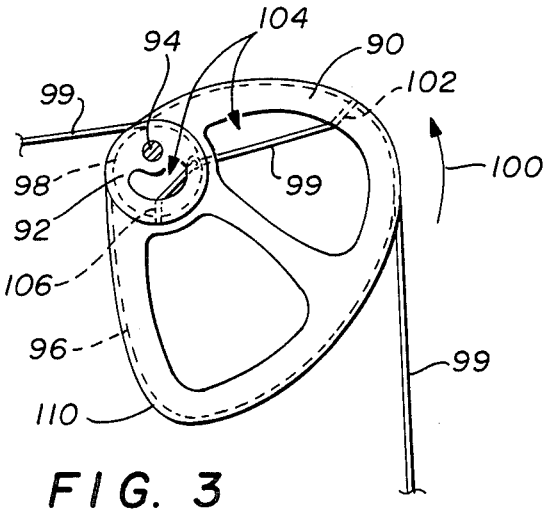
FIG. 3 is a side view of one of the pulley assemblies of the archery bow of FIG. 1.

Referring now to FIGS. 1 and 2, the reference numeral 10 generally indicates an archery bow constructed according to this invention. The archery bow includes handle 12 having a grip 14 adapted for manual contact and arrow rest 16. The handle also includes upper and lower forked ends 18 and 20 (a portion of which has been removed in FIG. 1 for clarity) and defines bow centerline 22. Upper limb 24 is pivotally connected to the upper fork of the handle by pivot pin 26. Likewise, lower limb 28 is pivotally connected to the lower fork of the handle by pivot pin 30. The limbs are constructed with a thicker portion adjacent the handle that is relatively rigid, and slender projecting portions terminating in tips 32 and 34, respectively, that are resilient. Preferably, the upper and lower limb tips are recurved, which increases the amount of energy that may be stored in the limbs. However, it is recognized that the limbs may be straight, if desired. Bowstring 40 is connected at either end to the tips of the upper and lower limbs, such as by lops 42 formed at either end of the bowstring engaging nocks 44 and 46 in the tips. The bowstring is longitudinally aligned with the centerline of the handle and includes a working stretch 48 that longitudinally intersects the arrow shelf. The working stretch is adapted to be received in the nock of an arrow (not shown).

Means are provided to vary the pull force to the archer as the bow is drawn. The means takes the form of a variable pulley device such as the upper and lower pulley assemblies, 50 and 54. Upper pulley assembly 50 is pivotally mounted in upper fork 18 on the face side of the handle, such as by pivot pin 52. Lower pulley assembly 54 is pivotally mounted in lower fork 20 on the face side of the handle, such as by pivot pin 56. The upper and lower pulley assemblies are longitudinally aligned with each other and both are offset from and parallel to the centerline of the bow. First tension cable 60 is connected at one end to the upper limb, such as is shown in FIG. 1*a*. Bolt 62 extends through the upper limb and is secured by nut 64. Hole 66 is formed in the end of the bolt and engages loop 68 formed in the tension cable. The first tension cable extends down to the lower pulley assembly and is operatively engaged therewith, as will be explained in greater detail hereinafter. The first tension cable continues from the lower pulley assembly to the lower limb and is connected to the lower limb, such as is shown in FIG. 1*b*. Threaded stud 74 extend through the lower limb and is secured thereto by jam nuts 76 and 78. Hole 80 is formed in the stud and engages loop 81 formed on the end of the first tension cable. Although not shown in detail, second tension cable 82 is connected at one end (at 84) to the lower limb as in FIG. 1*a*, extends to and operatively engages upper pulley assembly 52 and continues on to the upper limb, where the second tension cable is connected (at 86) to the upper limb, such as is shown in FIG. 1*b*.

Although both ends of the cable could be connected to the limbs by the arrangement shown in FIG. 1*a*, the structure shown in FIG. 1*b* provides means for independently adjusting the tension on each of the tension cables. That is, by loosening the jam nuts, the threaded stud 74 may be moved forward or backwards, relative to the limb, and then resecured by the jam nuts. The tension on the cable is determined by adjusting the relative position of the stud.

Figure 4:
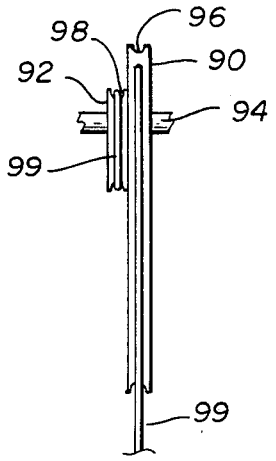
FIG. 4 is an edge view of the pulley assembly of FIG. 3.

One of the pulley assemblies is shown in detail in FIGS. 3 and 4, and includes curvalinear large pulley 90 and small circular pulley 92. The large and small pulleys are commonly mounted by pivot pin 94 to one of the forks on the face side of the handle. Although not shown, bearings or bushings may be mounted on the handle about the pivot pin to reduce friction during motion of the pulley assemblies. Preferably, the large and small pulleys are eccentrically mounted and each includes a circumferential track 96 and 98, respectively, adapted to receive tension cable 99. When the archery bow is in a relaxed state, such as is shown in FIGS. 1 and 2, the tension cable extends to the large pulley and enters the track as shown in FIGS. 3 and 4. The tension cable continues in the track in counter clockwise direction 100 (as seen in FIG. 3) and extends inwardly through radial passageway 102, cavity 104 and outwardly through radial passageway 106 in the small pulley. The tension cable then enters the track in the smaller pulley and continues around the pulley in a counter clockwise direction (as seen in FIG. 3) and finally extends from the pulley assembly to one of the limbs, where it is connected as shown in FIG. 1*b*. Although not shown, means may be provided, such as a set screw mounted in one of the pulleys, to secure the tension cables to the pulley assemblies to ensure common movement of the two.

As the bowstring is drawn back, the upper pulley assembly will rotate in a counter clockwise direction and the lower pulley assembly will rotate in a clockwise direction (both as seen in FIG. 1), each carrying their respective tension cables. The tension cables will each begin to wrap about the large pulleys and to unwrap from the small pulleys. It will be appreciated that the relative difference in the radii between the large and the small pulleys provides a proportional mechanical advantage in drawing the bowstring. The inherent mechanical advantage provided by the resilient limbs is thus varied by the pulley assembly as the bowstring is pulled back. In other words, the ratio of the relative radii of the large and small pulleys will increase in the initial stages of drawing the bowstring. As the bowstring continues to be drawn, the tension cables will pass point 110 on the large pulleys such that the ratio of the relative radii of the larger and smaller pulleys will begin to decrease. When the bowstring is fully drawn, the pulley assembly will have rotated approximately 180° from the position shown in FIG. 3. The radii of the large and small pulleys must be great enough not only to accommodate the movement of the tension cables, but also to compensate for flexure of the limbs as the bowstring is drawn back and energy is stored in the limbs. As the arrow is released, the motion of the pulley assemblies and the tension cables will be reversed, returning to the relaxed state shown in FIGS. 1 and 2.

Figure 5:
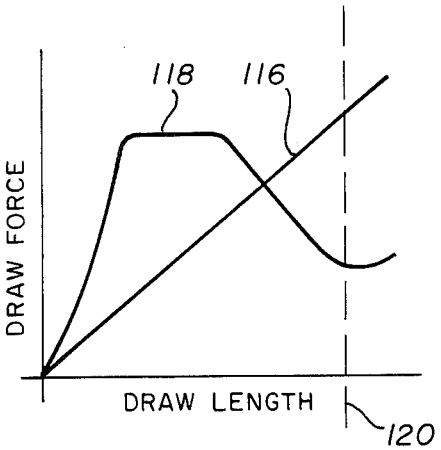
FIG. 5 is a graphical representation of the characteristics of the archery bow utilizing the pulley assembly of FIGS. 3 and 4.

This is graphically represented in FIG. 5, wherein the vertical axis is the force required to draw the bowstring from a relaxed position to the distance indicated on the horizontal axis. Line 116 represents the linear characteristics of a conventional long bow, wherein the draw force is directly proportional to the draw length. The area beneath the line is a measurement of the total energy stored in the bow in its fully drawn position, indicated at 120 on the horizontal position. Curved line 118 represents the characteristics of an archery bow constructed as in FIGS. 1 and 2. The initial portion of the line is at a steeper slope than the line 116 and quickly reaches a maximum well before the fully drawn position is reached (equivalent to the point 110 on the large pulley). Moreover, the draw force thereafter begins to decrease (representative of the portion of the large pulley beyond the point 110). The area under line 118 is greater than the area under the line 116 and thus indicates an increase in the energy stored in the archery bow of FIGS. 1 and 2. The lower force at the fully drawn position enables the archer to steady and aim the bow with greater precision than conventional bows. Further, the archery bow of this invention represents an improvement over existing compound bow designs in the amount of energy that is storable at the fully drawn position, since the initial slope of line 118 is generally greater than the corresponding function of such conventional bows. One of the primary advantages of this invention is that by mounting the pulley assemblies on the handle, which does not flex, the inertia of the limbs is reduced and greater energy and speed is transferred to the arrow as it is released from the bow. Further, the separation of the tension cables and the bowstring insures that any side force on the tension cables is not transferred to the bowstring, thus improving the accuracy of the bow.

Figure 6:
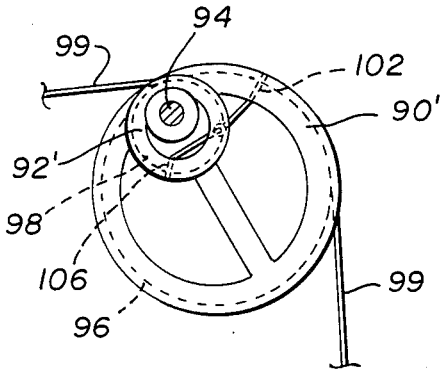
FIG. 6 is a side view of an alternative embodiment of the pulley assembly of the archery bow of this invention.

FIG. 6 shows an alternative pulley assembly in which the larger pulley 90' is circular, rather than curvalinear as in FIG. 3. Both the large and the smaller pulley 92 are commonly and eccentrically mounted on one of the forks of the handle as in the embodiment shown in FIGS. 1 and 2. Although somewhat less effective in storing energy and in providing a mechanical advantage to the archer than the curvalinear embodiment, the circular large pulley is somewhat less costly to construct. However, in all other respects this embodiment functions as hereinabove described. Of course, it is recognized that the pulley assemblies of this invention may employ a wide variety of large and small pulley sizes and shapes as may be found effective, and the common mounting point to the handle may be shifted relative to the centers of the pulleys as well.

Figure 7:
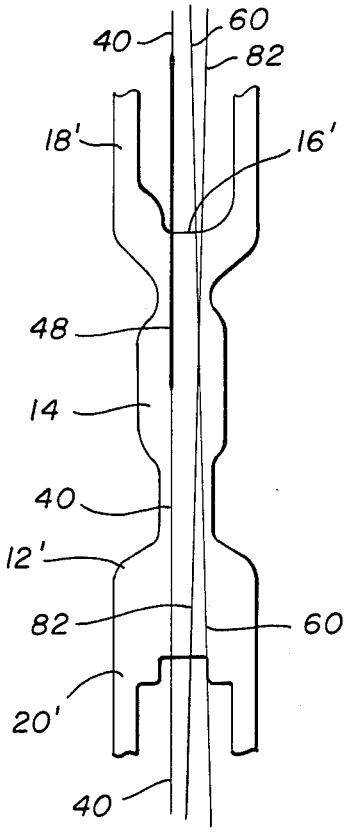
FIG. 7 is a back view of a portion of an alternate embodiment of the handle of this invention.

FIG. 7 shows an alternative embodiment 12' of the handle of this invention in which upper and lower forks 18' and 20', respectively, are extended towards the grip. Although not shown, the remainder of the archery bow functions and is constructed as in FIGS. 1 and 2.

Figure 8:
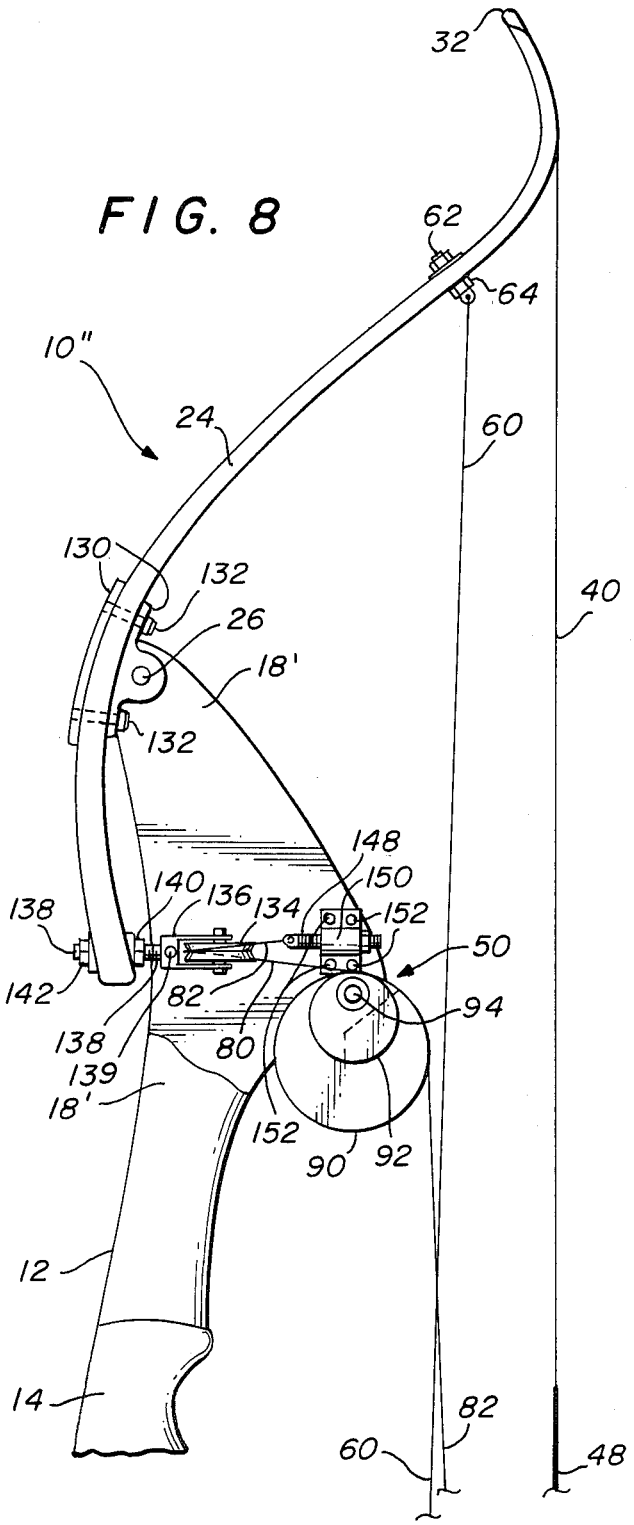
FIG. 8 is a side view, partially broken away, of the upper half of an alternate embodiment of the archery bow of this invention.
Figure 9:
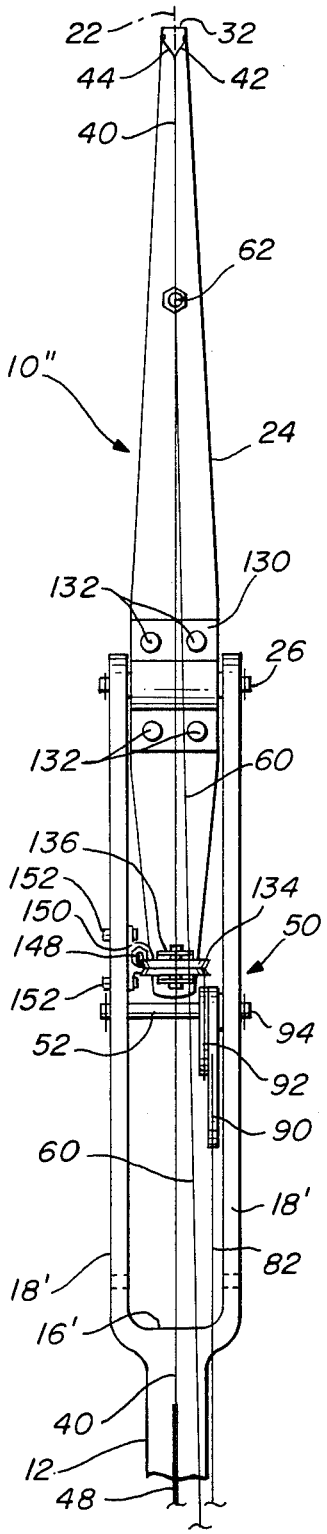
FIG. 9 is a back view of the archery bow of FIG. 8.

FIGS. 8 and 9 show yet another alternate embodiment 10'' of the archery bow of this invention. In the embodiment shown in FIGS. 8 and 9, only the upper portion of the archery bow is shown, although it is to be understood that the lower half of this embodiment is substantially identical in structure and function to that shown in the drawings. Upper limb 24 is pivotally secured to the upper portion of the handle such as by pivot pin 26 and secured by bracket 130 and bolts 132. Bowstring 40 extends between upper tip 32 and the lower tip (not shown) of the lower limb (not shown). Second tension cable 82 extends upwardly to upper pulley assembly 50. However, in this embodiment, the upper pulley assembly not only includes large 90 and small pulley 92 pivotally mounted by pin 94 on the back side of the handle, but further includes third pulley 134 rotatably mounted on bracket 136. Bracket 136 is pivotally secured to bolt 138 at 139. Bolt 138 is mounted on and extends through the lower end of upper limb 24 and secured by nuts 140 and 142. The first tension cable engages the circumferential tracks in the large and small pulleys 90, 92 as hereinabove described and extends to and engages a circumferential track in third pulley 134, generally transversely to the bowstring and then extends on and is secured to the end of bolt 148 such as is shown in FIG. 1*a*. Bolt 148 is secured to the back side of the handle such as by bracket 150 secured by bolts 152. Although not illustrated, the lower pulley assembly 54 employs a similar third pulley (not shown) which engages second tension cable 60 in a like manner.

The addition of the third pulley 134 to the pulley assemblies provides several advantages. First, the mechanical advantage provided by the upper and lower pulley assemblies to the archery bow of this invention is increased. Thus, the amount of energy that may be stored by the bow in its fully drawn position is likewise increased. Second, the center of rotation of the third pulley is preferrably longitudinally aligned with the axis 22 of the archery bow and therefore of the upper limb 24 as well. Thus, the force exerted on the upper limb through the bolt 138 applied along the center of the upper limb, as opposed to the embodiment of the invention as shown in FIG. 2 wherein the point of attachement to the upper limb is offset from the center line of the bow. This reduces any tendency of the upper limb to twist or deflect as an arrow is released from the bow. Third, the pivotal connection at 139 of the third pulley to the upper limb, enables the inclination of the pulley to be automatically adjusted as the bow string is drawn back, or as the arrow is released. The third pulley will automatically assume the inclination that minimizes the stress applied to the upper limb and also maintains the correct angular relationship between the third pulley and the large and small pulleys to maintain the tension cable within the circumferential tract of the third pulley. Finally, this pivotal connection thus allows a third pulley to have a circumferential tract that is substantially narrower than conventional pulleys, thus minimizing the mass of the bow and improving its strength and accuracy. Adjustment of the tension of the first and second tension cables continues to be independent in this embodiment such as by adjusting the relative position of bolts 142 or 148 in either of the upper or lower pulley assembles. In all other respects, the archery bow of this invention functions as hereinabove described with respect to FIGS. 1–6.

Although the invention has been disclosed above, with regard to particular and preferred embodiments, these are advanced for illustrative purposes only, and are not intended to limit the scope of this invention. For instance, a single tension cable, or more than two tension cables could be employed with the archery bow of this invention, all engaged with the pulley assemblies of this invention. Means may be provided to synchronize the motion of the upper and lower limbs, such as by a pair of additional pulleys, each concentrically mounted on the pivot pins supporting the upper and lower pulley assemblies. A separate cable could be engaged with both synchronization pulleys to balance the movement of the limbs. These nd other variations are within the scope of the invention.

What is claimed is:

1. An archery bow, comprising:

(a) a handle;

(b) a resilient upper limb and a resilient lower limb, each pivotally connected to opposite ends of said handle and presenting spaced tips;

(c) a bowstring connected at each end to said tips of said upper and lower limbs;

(d) upper and lower pulley means rotatively mounted on the bow in spaced relation intermediate the ends of said handle;

(e) tension cable means connected to said upper and lower limbs and operatively engaged with said upper and lower pulley means; and (f) whereby said bowstring and said tension cable means cooperate as said bowstring is pulled back to flex said upper and said lower limbs, wherein said tension cable means comprises:

(a) a first tension cable connected at one end to said upper limb, said first tension cable being operatively engaged with said lower pulley means and connected at another end to said handle; and (b) a second tension cable connected at one end to said lower limb, said second tension cable being operatively engaged with said upper pulley means and ocnnected at another end to said handle; and wherein said first and second pulley means each comprises: a large pulley and a small pulley eccentrically and rotatably mounted on said handle at a common point, and a third pulley rotatably mounted on one of said upper or lower limbs adjacent said large and small pulleys, each of said pulleys defining a circumferential track for receiving and conveying one of said first or said second tension cables and further comprising a conduit for conveying said first and second tension cable between said large and small pulleys as said pulleys rotate with respect to said handle.

2. The archery bow of claim 1, wherein said upper and said lower limbs each have a recurved tip.

3. The archery bow of claim 1, further comprising means for independently adjusting the tension of said first and second tension cables.

4. An archery bow, comprising:

(a) a handle;

(b) a resilient upper limb and a resilient lower limb, each pivotally connected to opposite ends of said handle and presenting spaced recurved tips;

(c) a bowstring connected at each end to said tips of said upper and lower limbs and defining a first plane with said handle;

(d) upper and lower pulley assemblies rotatively mounted on the archery bow in spaced relation intermediate the ends of said handle, each of said pulley assemblies including a large pulley and a small pulley connected to each other and eccentrically and rotatively mounted on said handle at a common point, said upper and said lower pulley assemblies with said handle defining a second plane parallel to said first plane;

(e) a first tension cable connected at one end to said upper limb between said tip thereof and said pivotal connection with said handle, said first tension cable being operatively engaged with said lower pulley means;

(f) a second tension cable connected at one end to said lower limb between said tip thereof and said pivotal connection with said handle, said second tension cable being operatively engaged with said upper pulley means; and wherein said upper and lower pulley assemblies each further comprises a third pulley rotatively mounted on one of said upper or lower limbs and one of said first or second tension cables extending from said large and small pulleys to said third pulley and operatively engaged therewith, with another end of said first or second tension cable being connected to said handle.

5. The archery bow of claim 4, wherein said large pulley is curvalinear in shape.

6. The archery bow of claim 4, wherein said large pulley is circular in shape.

7. The archery bow of claim 4, further comprising means for independently adjusting the tension on each of said first and said second tension cables.

8. An archery bow, comprising:

(a) a handle;

(b) a resilient upper limb and a reslilent lower limb, each pivotally connected to opposite ends of said handle and presenting spaced tips;

(c) a bowstring connected at each end to said tips of said upper and lower limbs;

(d) upper and lower pulley means rotatively mounted on the bow in spaced relation intermediate the ends of said handle;

(e) tension cable means connected to said upper and lower limbs and operatively engaged with said upper and lpwer pulley means; and (f) whereby said bowstring and said tension cable means cooperate as said bowstring is pulled back to flex said upper and said lower limbs, wherein said tension cable means comprises:

(a) a first tension cable connected at one end to said upper limb, said first tension cable being operatively engaged with said lower pulley means and connected at another end to said handle; and (b) a second tension cable connected at one end to said lower limb, said second tension cable being operatively engaged with said upper pulley means and connected at another end to said handle; and wherein said first and second pulley means each comprises; a large pulley and a small pulley rotatably mounted on said handle at a common point, at least one of the two pulleys being eccentrically mounted, and a third pulley rotatably mounted on one of said upper or lower limbs adjacent said large and small pulleys, each of said pulleys defining a circumferential track for receiving and conveying one of said first or said second tension cables and further comprising a conduit for conveying said first and second tension cable between said large and small pulleys as said pulleys rotate with respect to said handle.

9. An archery bow, comprising:

(a) a handle;

(b) a resilient upper limb and a resilient lower limb, each pivotally connected to opposite ends of said handle and presenting spaced recurved tips;

(c) a bowstring connected at each end to said tips of said upper and lower limbs and defining a first plane with said handle;

(d) upper and lower pulley assemblies rotatively mounted on the archery bow in spaced relation intermediate the ends of said handle, each of said pulley assemblies including a large pulley and a small pulley connected to each other and rotatively mounted on said handle at a common point, at least one of the two pulleys being eccentrically mounted, said upper and said lower pulley assemblies with said handle defining a second plane parallel to said first plane;

(e) a first tension cable connected at one end to said upper limb between said tip thereof and said pivotal connection with said handle, said first tension cable being operatively engaged with said lower pulley means; and (f) a second tension cable connected at one end to said lower limb between said tip thereof and said pivotal connection with said handle, said second tension cable being operatively engaged with said upper pulley means; and wherein said upper and lower pulley assemblies each further comprises a third pulley rotatively mounted on one of said upper or lower limbs and one of said first or second tension cables extending from said large and small pulleys to said third pulley and operatively engaged therewith, with another end of said first or second tension cable being connected to said handle.

* * * * *